US008725056B2

(12) United States Patent
Ichikawa

(10) Patent No.: US 8,725,056 B2
(45) Date of Patent: May 13, 2014

(54) IMAGE FORMING APPARATUS

(75) Inventor: Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 700 days.

(21) Appl. No.: 12/696,087

(22) Filed: Jan. 29, 2010

(65) Prior Publication Data

US 2010/0189485 A1 Jul. 29, 2010

(30) Foreign Application Priority Data

Jan. 29, 2009 (JP) ..... 2009-017871

(51) Int. Cl.
*G03G 15/00* (2006.01)
*B65H 5/36* (2006.01)

(52) U.S. Cl.
USPC ..... 399/388

(58) Field of Classification Search
CPC ..... G03G 15/00; B65H 5/36
USPC ..... 399/388
See application file for complete search history.

(56) References Cited

U.S. PATENT DOCUMENTS

| | | | | | |
|---|---|---|---|---|---|
| 3,986,712 | A * | 10/1976 | Hasegawa | ..... | 271/124 |
| 4,714,338 | A * | 12/1987 | Iida et al. | ..... | 399/70 |
| 7,380,787 | B2 * | 6/2008 | Fukumura | ..... | 271/264 |
| 2003/0086733 | A1 * | 5/2003 | Sawai et al. | ..... | 399/302 |
| 2005/0152723 | A1 * | 7/2005 | Nishikata et al. | ..... | 399/367 |
| 2007/0269242 | A1 * | 11/2007 | Hattori et al. | ..... | 399/316 |
| 2007/0269244 | A1 * | 11/2007 | Miwa et al. | ..... | 399/316 |
| 2009/0184461 | A1 * | 7/2009 | Ishikawa et al. | ..... | 271/254 |

FOREIGN PATENT DOCUMENTS

| | | | | | |
|---|---|---|---|---|---|
| JP | 58137864 | A * | 8/1983 | ..... | G03G 15/00 |
| JP | 63180650 | A * | 7/1988 | ..... | G03G 15/00 |
| JP | 63226681 | A * | 9/1988 | ..... | G03G 15/00 |
| JP | 01178991 | A * | 7/1989 | ..... | G03G 5/36 |
| JP | 04039242 | A * | 2/1992 | ..... | B65H 5/36 |
| JP | 05072932 | A * | 3/1993 | ..... | G03G 15/00 |
| JP | 06-003951 | | 1/1994 | | |
| JP | 06-009101 | | 1/1994 | | |
| JP | 06009101 | A * | 1/1994 | ..... | B65H 5/36 |

(Continued)

OTHER PUBLICATIONS

Notice of Reasons for Rejection dated Dec. 7, 2010 in Japanese Application No. 2009-017871 and English translation thereof.

(Continued)

*Primary Examiner* — Nguyen Ha
(74) *Attorney, Agent, or Firm* — Banner & Witcoff, Ltd.

(57) ABSTRACT

An image forming apparatus includes an image forming unit, an inner guide, an outer guide opposing the inner guide. The inner guide and the outer guide define a curved transporting path where the recording sheet is transported. The image forming apparatus further includes a first feeder positioned upstream of the curved transporting path and a second feeder positioned downstream of the curved transporting path. The outer guide includes a rigid guide and a deformable resilient guide superimposed on the rigid guide. The rigid guide includes a first outer guide portion extending to a first downstream position and a second outer guide portion extending to a second downstream position positioned downstream of the first downstream position. A first resilient guide portion of the resilient guide, which corresponds to the first outer guide portion, extends to a third downstream position positioned downstream of the first downstream position and does not extend beyond the second downstream position.

20 Claims, 7 Drawing Sheets

(56) References Cited

FOREIGN PATENT DOCUMENTS

| | | | | | |
|---|---|---|---|---|---|
| JP | 09221248 | A | * | 8/1997 | ..... B65H 5/36 |
| JP | 10035946 | A | * | 2/1998 | ..... B65H 5/36 |
| JP | 2000-355441 | | | 12/2000 | |
| JP | 2003-212376 | | | 7/2003 | |
| JP | 2003-321144 | A | | 11/2003 | |
| JP | 2004-269098 | | | 9/2004 | |
| JP | 2004269098 | A | * | 9/2004 | ..... B65H 3/38 |
| JP | 2006089232 | A | * | 4/2006 | ..... B65H 5/36 |
| JP | 2006-248730 | A | | 9/2006 | |
| JP | 2006248730 | A | * | 9/2006 | ..... B65H 5/36 |
| JP | 2007-106551 | | | 4/2007 | |
| JP | 2007106551 | A | * | 4/2007 | |

OTHER PUBLICATIONS

The First Office Action for Chinese patent application No. 201010120045.4 mailed Feb. 15, 2012.

Chinese Patent Application No. 201010120045.4—Second Office Action dated Oct. 18, 2012.

* cited by examiner

IMAGE FORMING APPARATUS

CROSS REFERENCE TO RELATED APPLICATION

The present application claims priority from Japanese Patent Application No. 2009-017871, filed on Jan. 29, 2009, the disclosure of which is incorporated herein by reference in its entirely.

BACKGROUND

1. Technical Field

The present invention relates to an image forming apparatus having a curved transporting path.

2. Related Art

A paper transporting device having a transporting path made up of a curved paper guide panel and including a resilient film fixed to the paper guide panel is known. The paper transporting device may restrain generation of a noise caused by springback of a trailing end of a paper when the paper passes through the curved transporting path. A center portion of a downstream end with respect to the transport direction of the paper guide panel is formed to be depressed upstream with respect to the transport direction, and a downstream end with respect to the transport direction of the resilient film totally projects from the downstream end with respect to the transport direction of the paper guide panel.

In this technology, even when the trailing end of the paper guided by the paper guide panel in a state of being curved pops out from the downstream end with respect to the transport direction of the paper guide panel and tries to spring back energetically therefrom, the noise caused by the springback of the trailing end may be restrained by holding down the energy by a cushioning effect of the resilient film.

In recent years, the degree of the curve of the transporting path is increasing in associating with downsizing of the image forming apparatus. When feeding a leading end of the paper to a specific point (for example, a nip position between a pair of rollers) in such the curved transporting path, if the paper is relatively rigid, the resilient film projecting from the downstream end of the paper guide panel is deflected by being pressed by the leading or trailing end of the paper, and hence feeding the leading end of the paper to the specific point may be failed. Such the problem may occur in the same manner in the technology which needs to guide the paper not only to the nip position of the pair of rollers, but also to a nip position of a feeder such as a belt unit.

SUMMARY

A need has arisen to provide an image forming apparatus or a paper transporting device which achieves improvement of restraint of a noise caused by springback of a trailing end of a paper (recording sheet) along with maintaining guiding function.

According to an embodiment of the invention, an image forming apparatus comprises an image forming unit configured to form an image on a recording sheet, a feeder configured to nip and transport the recording sheet. The image forming apparatus further comprises guide portions that define a curved transporting path configured to guide the recording sheet in a transport direction toward the feeder while bending the recording sheet into an arcuate shape. The guide portions include an outer guide arranged on an outer peripheral side of the curved transporting path and an inner guide arranged on an inner peripheral side so as to oppose the outer guide. The outer guide includes a rigid guide and a deformable resilient guide superimposed with each other. The rigid guide is formed into a shape in which a downstream end thereof with respect to the transport direction comes to a different position with respect to the transport direction at least partly in a widthwise direction orthogonal to the transport direction. The resilient guide includes a deformable free end protruding at least partly from the end of the rigid guide at an downstream end with respect to the transport direction by being extended to a same position as a downstream-most end with respect to the transport direction of the rigid guide.

According to an embodiment of the invention, an image forming apparatus comprises an image forming unit configured to form an image on a recording sheet, an inner guide and an outer guide opposing the inner guide. The inner guide and the outer guide define a curved transporting path where the recording sheet is transported in a transport direction. The inner guide is positioned inside the curved transporting path and the outer guide is positioned outside the curved transporting path. The image forming apparatus further comprises a first feeder configured to feed the recording sheet to the curved transporting path and a second feeder configured to nip and feed the recording sheet passing through the curved transporting path out of the curved transporting path. The outer guide includes a rigid guide and a deformable resilient guide. The resilient guide is superimposed on the rigid guide. The rigid guide includes a first outer guide portion and a second outer guide portion. The first outer guide portion extends in the transport direction to a first downstream position. The second outer guide portion extends in the transport direction to a second downstream position positioned downstream of the first downstream position. A first resilient guide portion of the resilient guide, which corresponds to the first outer guide portion, extends in the transport direction to a third downstream position which is positioned downstream of the first downstream position and does not extend beyond the second downstream position such that a downstream end of the first resilient guide portion is deformable as a free end.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Embodiments of the invention and their features and advantages may be understood by referring to FIGS. 1-7, like numerals being used for like corresponding parts in the various drawings. In the description given below, an entire configuration of a color printer as an example of an image forming apparatus in brief first, and then characteristic portions of the invention will be described in detail. In the description given below, the terms "upstream" and "downstream" mean upstream and downstream with respect to the transport direction of papers or recording sheets unless otherwise specifically noted.

Figure 1:
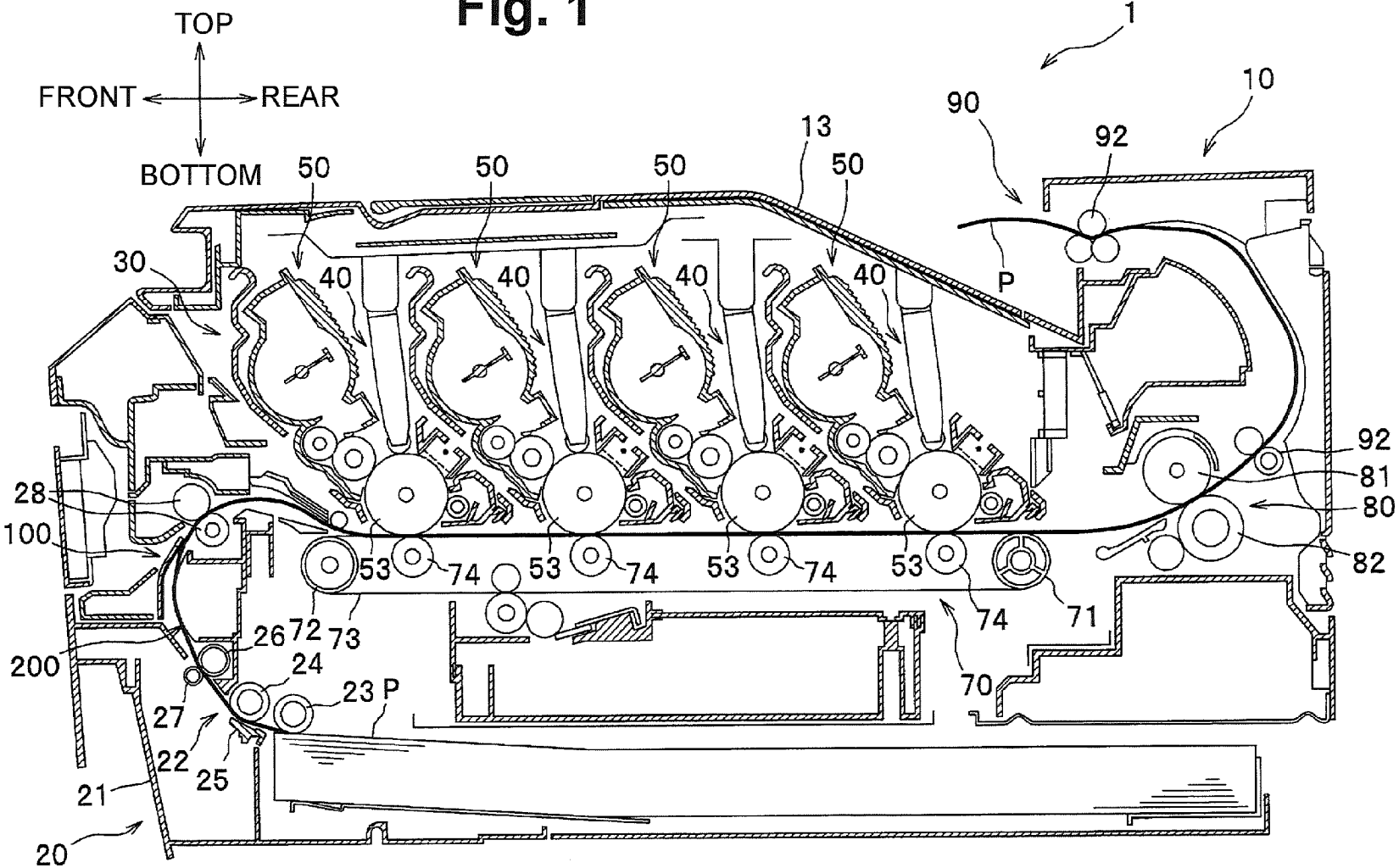
FIG. 1 is a cross-sectional view showing an image forming apparatus as an example of the invention.

As shown in FIG. 1, a color printer 1 includes a paper feed unit 20 configured to feed a paper P (an example of a recording sheet), an image forming unit 30 configured to form an image on the fed paper P, and a paper discharge portion 90 configured to discharge the paper P having the image formed thereon to the exterior of an apparatus body 10.

The paper feed unit 20 includes a paper feed tray 21 configured to store the papers P and a paper feed mechanism 22 configured to feed the paper P in the paper feed tray 21 to the image forming unit 30. The paper feed mechanism 22 includes a paper feed roller 23, a separation roller 24, a separation pad 25, a transporting roller 26, a paper powder removing roller 27, register rollers 28 including a pair of rollers which come into contact with each other as an example of a feeder, and an outer guide 100 and an inner guide 200 as a guide unit. Detailed structures of the outer guide 100 and the inner guide 200 will be described later in detail.

In the paper feed unit 20 configured in this manner, the papers P in the paper feed tray 21 are separated one by one and fed upward, are subjected to removal of paper powder in a course of passing between the transporting roller 26 and the paper powder removing roller 27, are redirected toward the rear by the outer guide 100 and the inner guide 200, and are guided between the pair of register rollers 28. Then, by the rotation of the pair of register rollers 28 in a state of nipping the paper P, the paper P is transported to the image forming unit 30.

The image forming unit 30 mainly includes four LED units 40, four process cartridges 50, a belt unit 70, and a fixing unit 80.

The LED units 40 each include a plurality of LEDs for exposing a photosensitive drum 53, described later.

The process cartridges 50 are aligned in the fore-and-aft direction, and each include the photosensitive drum 53 as an example of a photosensitive member which carries toner images (developer images), a charger, a developing roller, and a toner storage chamber which are publicly known and hence are shown without reference numerals.

The belt unit 70 mainly includes a drive roller 71, a driven roller 72, a transporting belt 73, and transfer rollers 74 as an example of a transfer member.

The drive roller 71 and the driven roller 72 are arranged in parallel so as to be apart from each other in the fore-and-aft direction, and the transporting belt 73 formed of an endless belt is tightly extended therebetween. The transporting belt 73 is arranged so as to oppose the respective photosensitive drums 53. Arranged inside the transporting belt 73 are the four transfer rollers 74 configured to nip the transporting belt 73 in cooperation with the respective photosensitive drums 53 and arranged so as to oppose the respective photosensitive drums 53. The transfer rollers 74 each are subjected to application of a transfer bias by constant current control at the time of transfer.

The fixing unit 80 includes a heat roller 81, and a pressure roller 82 configured to press the heat roller 81.

In the image forming unit 30 configured in this manner, the surfaces of the respective photosensitive drums 53 are charged uniformly by the chargers first, and then are exposed by the respective LED units 40. Accordingly, potentials of the exposed portions are lowered, and electrostatic latent images on the basis of image data are formed on the respective photosensitive drums 53. Subsequently, toner is supplied to the electrostatic latent images by the developing rollers, so that toner images are carried on the photosensitive drums 53.

Subsequently, the transfer biases are applied to the respective transfer rollers 74 while the paper P is transported between the respective photosensitive drums 53 and the transporting belt 73, and the toner images formed on the respective photosensitive drums 53 are attracted by the respective transfer rollers 74 and are transferred to the paper P. Then, the paper P passes between the heat roller 81 and the pressure roller 82, and the toner images transferred onto the paper P is heat-fixed.

The paper discharge portion 90 mainly includes a plurality of pairs of transporting rollers 92 configured to transport the paper P. The paper P having the toner images transferred and heat-fixed thereto is discharged out from the apparatus body 10 by the transporting roller 92, and is accumulated in a paper discharge tray 13.

<Configurations of Outer Guide and Inner Guide>

Figure 2:
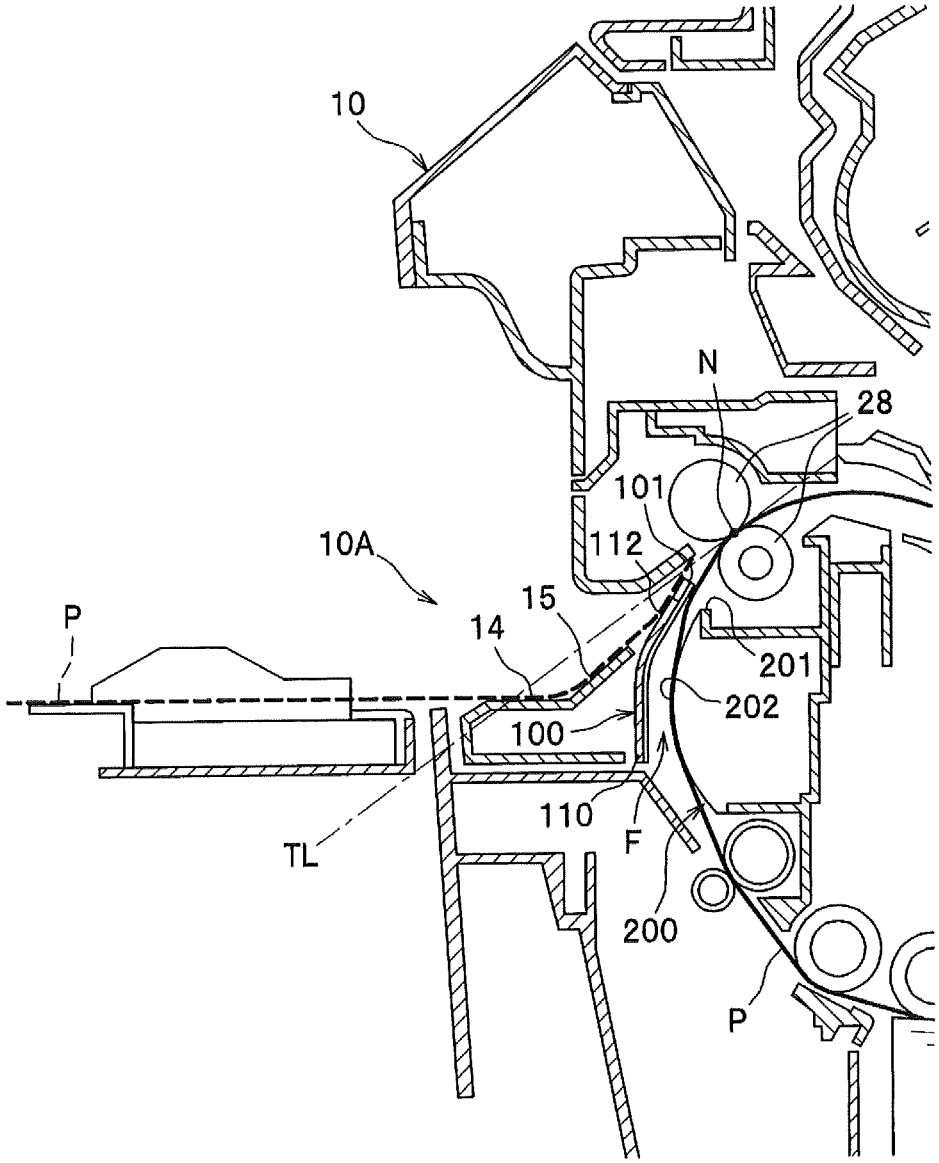
FIG. 2 is an enlarged cross-sectional view showing a structure of an outer guide and an inner guide and a periphery thereof.

Subsequently, the configurations of the outer guide 100 and the inner guide 200 will be described. As shown in FIG. 2, the outer guide 100 and the inner guide 200 are arranged at a distance from each other, and define a curved transporting path F configured to bend the paper P into an arcuate shape in side view (into an arcuate shape directed in the transport direction) toward the register rollers 28 therebetween.

The outer guide 100 is arranged on the outer peripheral side of the curved transporting path F, and the inner guide 200 is arranged on the inner peripheral side of the transporting path F so as to oppose the outer guide 100. The outer guide 100 is arranged in such a manner that a downstream end portion 101 is arranged in the proximity of a nip portion N of the register rollers 28. The inner guide 200 includes a downstream end portion 201 positioned upstream from the downstream end portion 101 of the outer guide 100 and includes a rib 202 in an arcuate shape in side view for supporting the paper P.

Then, the outer guide 100 and the inner guide 200 are positioned on the lower side (the side of one of the register rollers 28) with respect to a common tangent line TL at the nip portion N (nip position) of the pair of register rollers 28, and the downstream end portion 101 of the outer guide 100 is also positioned on a same inner side. The outer guide 100 and the inner guide 200 are configured as described above, therefore, the leading end of the paper P which is an downstream end is guided toward the nip portion N of the register rollers 28 in a state of being in contact with the downstream end portion 101 of the outer guide 100 and the part of the inner guide 200 positioned upstream from the downstream end portion 101 (for example, a top portion of the rib 202).

<Detailed Structure of Outer Guide>

Figure 3A:
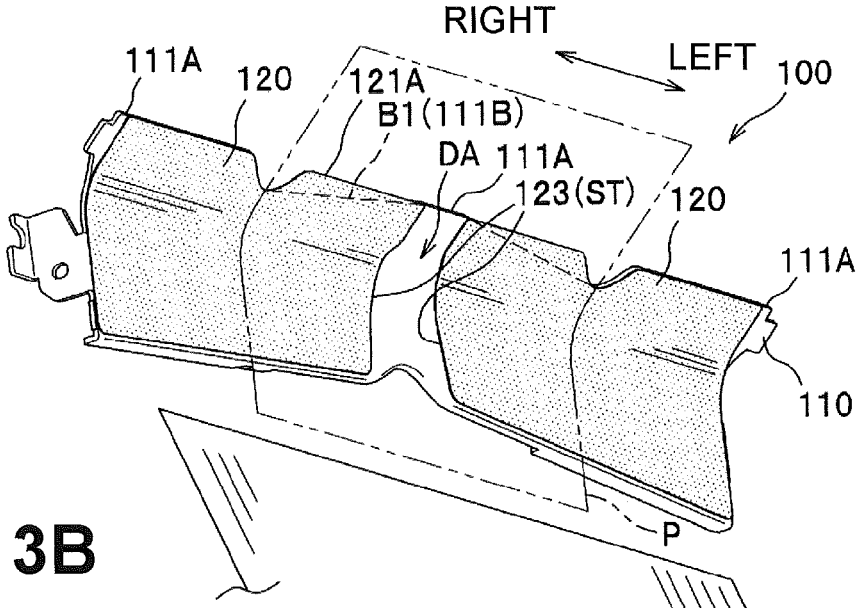
FIG. 3A is a perspective view showing the outer guide.
Figure 3B:
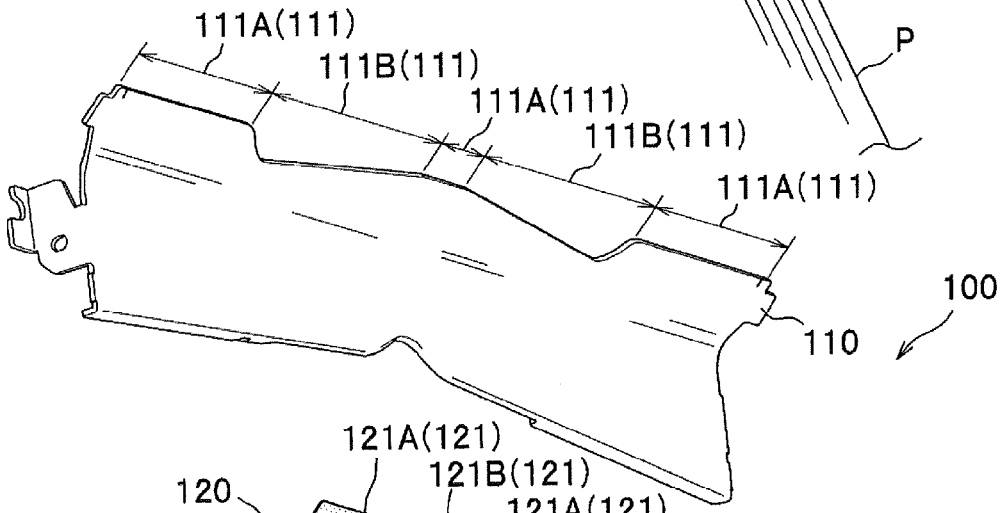
FIG. 3B is an exploded perspective view showing a state in which resin films are peeled off a metallic panel of the outer guide.

Subsequently, a detailed structure of the outer guide 100 will be described. As shown in FIG. 3A and FIG. 3B, the outer guide 100 includes a metallic panel 110 (conductive member) as an example of a rigid guide, and two resin films 120, as an example of the resilient guides, superimposed to the metallic panel 110.

The metallic panel 110 is formed to have a width which accommodates at least two types of papers P having different widths. In other words, it is formed to have a width substantially equal to or larger than the width of the paper P having the largest width from among a plurality of types of papers P which are usable in the color printer 1 for printing. The metallic panel 110 is bent into substantially an L-shape and is electrically grounded. The metallic panel 110 may be grounded via an electric resistance element or an electric element such as a Zener diode.

The metallic panel 110 is formed into a shape in which at least part of a downstream end portion 111 in the widthwise direction orthogonal to the transport direction comes to a different position from the remaining portion of the downstream end portion 111. More specifically, in this embodiment, the downstream end portion 111 of the metallic panel 110 has a shape including three downstream extremities 111A formed at widthwise both sides and a widthwise center, and two depressed portions 111B formed between the respective downstream extremities 111A so as to be depressed upstream from the downstream extremities 111A. Then, the metallic panel 110 is formed in such a manner that bottom portions of the respective depressed portions 111B are arranged at positions corresponding to widthwise both edges of the paper P having the smallest width such as a post card among the papers P in various sizes which are usable for printing by the color printer 1.

The downstream end portion 111 of the metallic panel 110 formed in this manner has a symmetrical shape in the widthwise direction with reference to the center of the paper P to be transported. Then, two depressed portions 111B of a substantially V-shape are formed at both sides of the downstream extremity 111A at the center from among the three downstream extremities 111A, and hence the widthwise center portion of the downstream end portion 111 of the metallic panel 110 is formed into an angular shape having a top at the downstream extremity 111A at the center (a portion corresponding to the center of the paper P to be transported).

As shown in FIG. 2, the surface of the metallic panel 110 on the opposite side from the inner guide 200 is formed into a flat shape as a guide surface 112 for guiding the paper P linearly toward the register rollers 28. The apparatus body 10 is formed with a manual paper feed port 10A, and is formed with manual paper feed guide surfaces 14 and 15 configured to guide the paper P to be inserted from the manual paper feed port 10A toward the guide surface 112 of the metallic panel 110. In other words, part of a manual paper transporting path configured to guide the paper P inserted from the manual paper feed port 10A from the manual paper feed port 10A to the register rollers 28 is defined by the metallic panel 110.

Figure 3C:
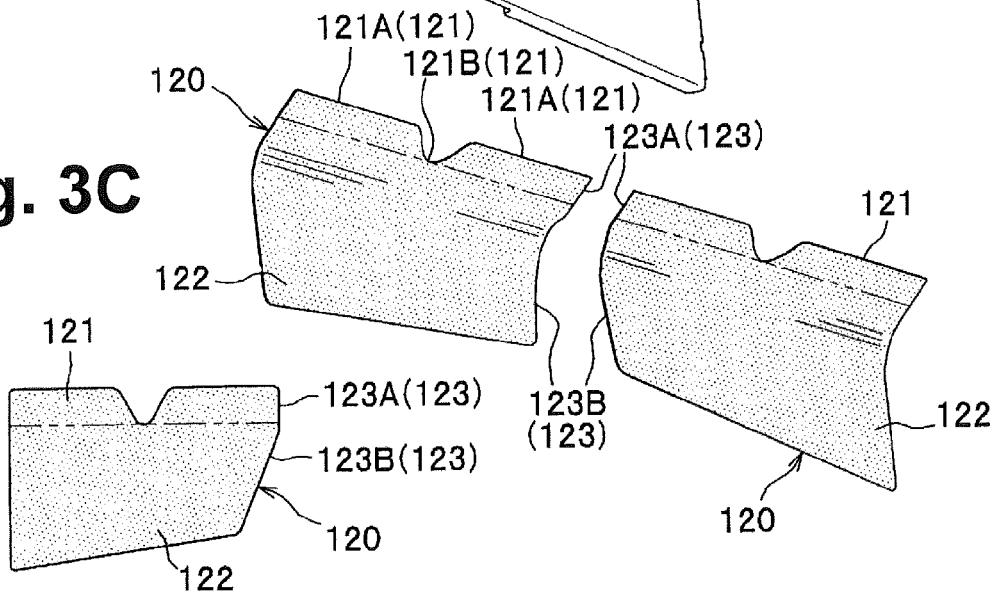
FIG. 3C is a plan view showing the resin films of the outer guide.

As shown in FIGS. 3A and 3C, the resin films 120 are resiliently deformable films, and are bonded on the surface of the metallic panel 110 on the side of the transporting path F (recording sheet transporting surface) one by one so as to cover left and right both side portions to allow only the lateral center portion of the metallic panel 110 to be exposed toward the inner guide 200. Accordingly, the metallic panel 110 comes into abutment with the widthwise center portion of the paper P fed from the upstream side. The two resin films 120 are widthwise symmetry with reference to the center of the paper P to be transported.

A downstream end portion 121 (a downstream end portion) of the resin film 120 includes two downstream extremities 121A formed in parallel with the downstream extremities 111A of the metallic panel 110 and a notch 121B formed between the two downstream extremities 121A so as to be depressed toward the upstream. The notch 121B is formed so that the bottom portion is arranged at a position corresponding to the widthwise both edges of the paper P having the smallest width such as the post card, that is, at a position corresponding to the bottom portion of the depressed portions 111B of the metallic panel 110.

The notch 121B is formed in such a manner that the width of the opening is smaller than the depressed portions 111B of the metallic panel 110. Therefore, the downstream extremities 121A of the resin films 120 positioned on the laterally inner sides of the metallic panel 110 are formed to extend widthwise outward respectively from the downstream extremities 111A of the metallic panel 110 at the widthwise center and then be bent toward the bottom portions of the depressed portions 111B before reaching the downstream extremities 111A at the widthwise both sides.

Then, when the resin films 120 are bonded to widthwise outside portions of the metallic panel 110 in such a manner that the respective downstream extremities 121A match substantially with the downstream extremities 111A of the metallic panel 110, as shown in FIG. 3A, the downstream extremities 121A of the resin films 120 on the laterally inner sides of the metallic panel 110 protrude from laterally inside portions B1 of the depressed portions 111B of the metallic panel 110. In other words, the downstream extremities 121A on the laterally inner sides of the resin films 120 assume free ends which are resiliently deformable by protruding from the laterally inside portions B1 of the depressed portions 111B of the metallic panel 110, and extending to the positions the same as the downstream extremities 111A of the metallic panel 110.

The resin films 120 each are fixed only at a base portion 122 on the upstream (the portion on the upstream from a double-dashed chain line in the drawing) to the metallic panel 110 with an adhesive agent, and the downstream end portion 121 on the downstream from the base portion 122 corresponds to the free end. Then, portions 123A of respective side surfaces 123 on the laterally inner side of the two resin films 120 corresponding to the downstream end portions 121 are formed linearly along the transport direction and portions 123B corresponding to the base portions 122 are inclined so as to widen toward the upstream side. More specifically, as shown in FIG. 3C, the portion 123B of the side surface 123 corresponding to the base portion 122 is formed in such a manner that a downstream portion is formed linearly along the portion 123A corresponding to the downstream end portion 121.

By bonding the resin films 120 in this manner, as shown in FIG. 3A, an exposed area DA of the outer guide 100, where the metallic panel 110 is exposed, is formed continuously from one end to the other end of the metallic panel 110 with respect to the transport direction of the paper P at the lateral center portion of the metallic panel 110. By bonding the resin films 120 onto the metallic panel 110, the resin films 120 protrude from the metallic panel 110 toward the transporting path F, and hence the respective side surfaces 123 of the resin films 120 form stepped surfaces ST with respect to the metallic panel 110.

<Detailed Structure of Paper Feed Mechanism>

Subsequently, a detailed structure of the paper feed mechanism 22 will be described. The paper feed mechanism 22 shown in FIG. 1 is configured to provide a stronger transporting force in a portion corresponding to the exposed area DA in comparison with an area covered with the resin films 120 in the outer guide 100.

Specifically, in this embodiment, the transporting force in the portion corresponding to the exposed area DA grows stronger by providing the transporting roller 26 and the paper powder removing roller 27 only at the widthwise center portion of the paper P. In this configuration, the center portion of the leading end side of the paper P transported by the transporting roller 26 and the paper powder removing roller 27 is pressed against the exposed area DA along the stepped surfaces ST, and assumes a curved shape protruding toward the exposed area DA.

The register rollers 28 are formed to have a length substantially the same as the width of the paper P. Accordingly, the shape of the paper P in a portion around the portion nipped by the register rollers 28 (specifically the portion upstream from the register rollers 28) is not curved and assumes a substantially flat shape.

<Action of Outer Guide>

Subsequently, the action of the outer guide 100 will be described. As shown in FIG. 4A, when a print command is issued to the color printer 1, the paper P in the paper feed tray 21 is fed toward the outer guide 100 by the paper feed mechanism 22. Then, when the widthwise center portion of the leading end of the paper P comes into abutment with the outer guide 100, the widthwise center portion of the paper P enters between the pair of stepped surfaces ST shown in FIG. 3A and is curved so as to protrude toward the exposed area DA.

Then, the paper P curved at a leading end portion comes into abutment at the leading end portion with the exposed area DA of the metallic panel 110 in a state in which the rear portion stays in the paper feed tray 21 (see FIG. 4A). Accordingly, static electricity charged in the paper P is released via the metallic panel 110, so that the duplicated feeding of the paper P is restrained.

Subsequently, the leading end portion of the paper P in abutment with the metallic panel 110 is pressed by the pair of stepped surfaces ST which are narrowed toward the downstream side in the direction away from the metallic panel 110, and hence assumes a substantially flat shape and comes into abutment only with the two resin films 120. Then, after the leading end portion of the paper P in the flat shape has passed through and left a bent portion of the outer guide 100, as shown in FIG. 2, the portion of the paper P other than the leading end portion moves gradually away from the outer guide 100, and is supported by the inner guide 200.

Figure 4B:
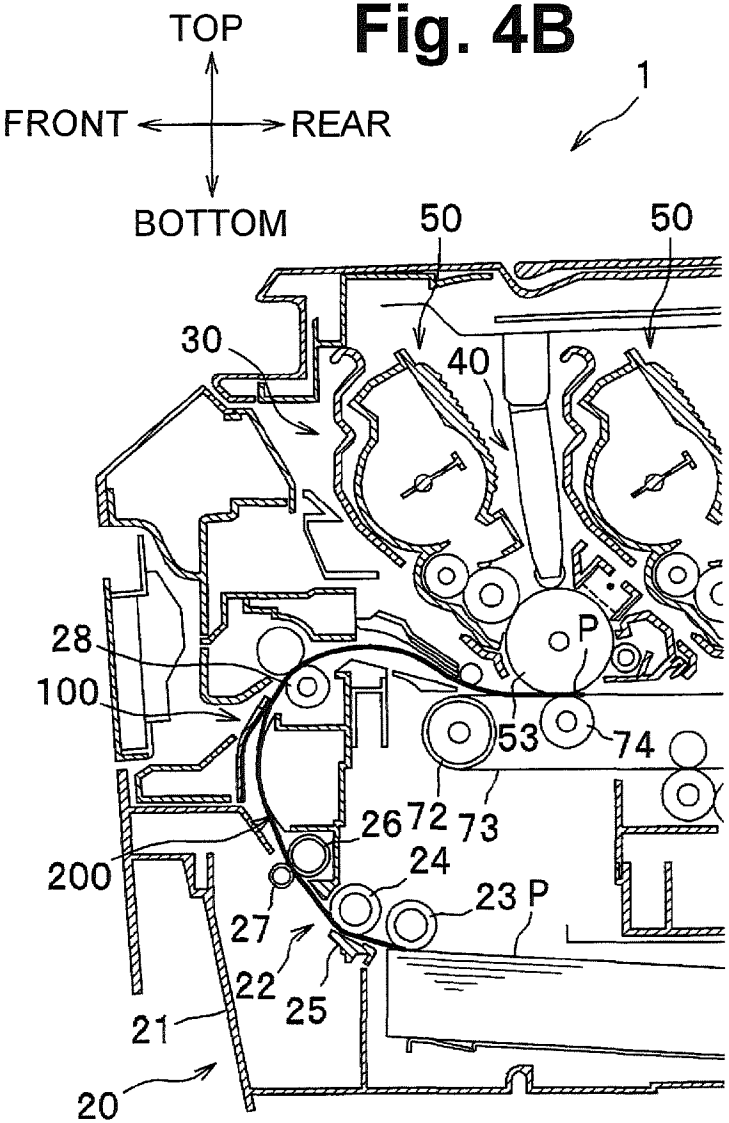
FIG. 4B is a cross-sectional view showing a state in which a leading end of a paper reaches a transfer roller.
Figure 4A:
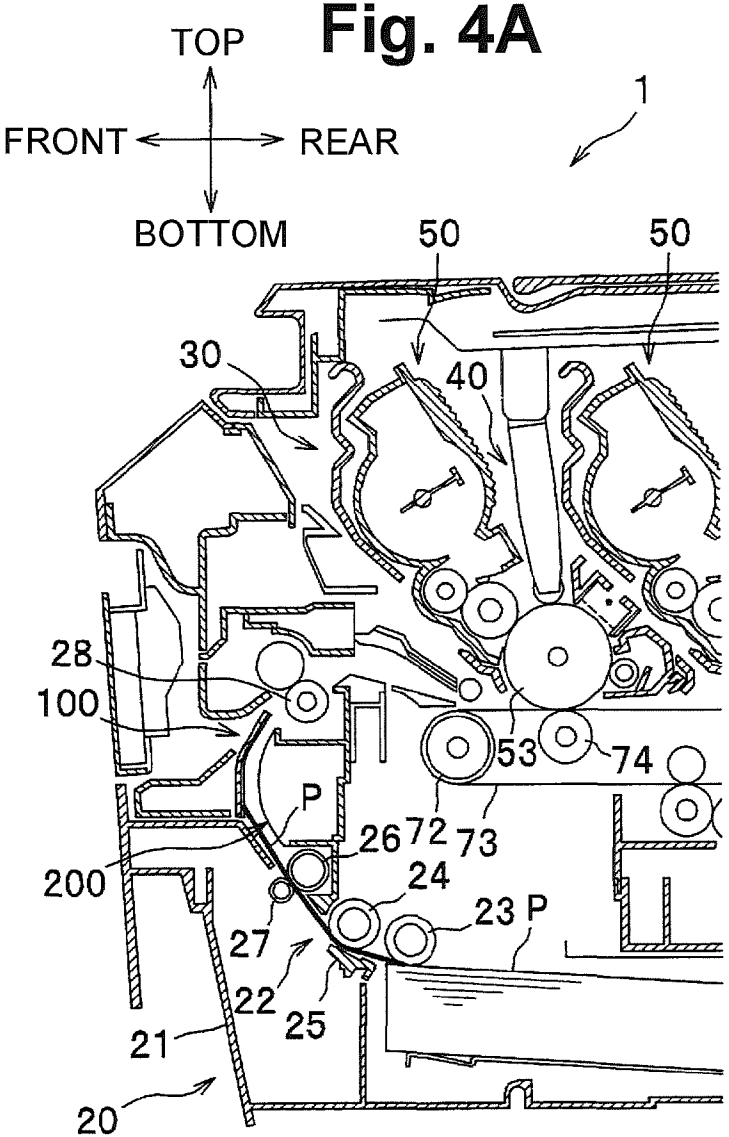
FIG. 4A is a cross-sectional view showing a state in which a leading end of a paper comes into abutment with the outer guide.

Subsequently, as shown in FIG. 4B, when the paper P is transported by the register rollers 28 and the leading end portion reaches the transfer roller 74, the paper P is lifted from the exposed area DA and is in sliding contact only with the resin films 120. Therefore, a transfer current is prevented from being leaked via the paper P having absorbed moisture from the transfer roller 74 or the metallic panel 110.

From then on, the trailing end of the paper P leaves the downstream end portion 101 of the outer guide 100. In this circumstance, if the paper P is the post card, it leaves the depressed portions 111B (inclined surfaces of the angular portions at the center of the downstream end portion 111) gradually from widthwise outer side portions of the trailing end thereof as shown in FIG. 3A. In this case, the widthwise outer side portions of the trailing end of the paper P left from the depressed portions 111B press and deflect parts of the resin films 120 which correspond to the free end toward the metallic panel 110, as shown in FIG. 5B, and hence the radius of curvature thereof in side view is larger than before it leaves. Accordingly, a force exerted to the outer guide 100 from the widthwise outside portions of the trailing end of the paper P is absorbed by the deflecting deformation of the resin film 120, so that the energy of springback of the trailing end of the paper P is reduced when the center portion of the trailing end of the paper P leaves finally the downstream extremities 111A, whereby the noise caused by the springback of the trailing end is restrained.

Figure 5A:
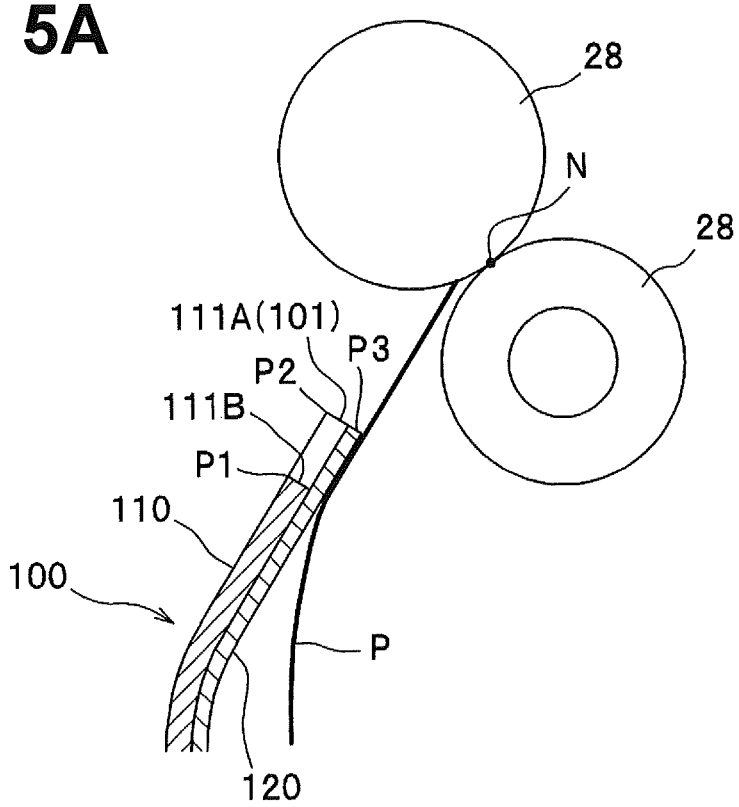
FIG. 5A is an enlarged cross-sectional view showing a state in which the leading end of the paper is guided to a portion in the vicinity of a nip portion of register rollers by the outer guide.
Figure 5B:
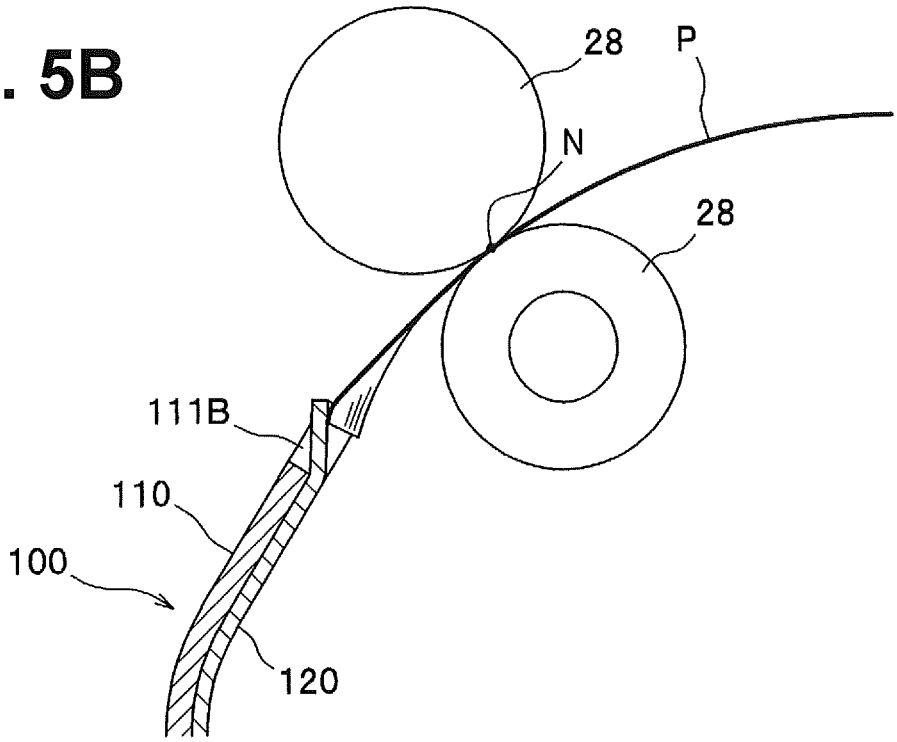
FIG. 5B is an enlarged cross-sectional view showing a state in which a trailing end of the paper is about to leave the outer guide.

When the leading end portion of the paper P is guided toward the nip portion N of the register rollers 28, as shown in FIG. 5A, the leading end portion of the paper P is reliably supported by the downstream extremities 111A (at second downstream position P2) of the metallic panel 110 as the rigid member and is guided toward the portion near the nip portion N of the register rollers 28 when leaving the downstream end portion 101 of the outer guide 100. In this case, even when the paper P is the post card (the elastic narrow paper), the widthwise center portion of the paper P is reliably guided by the downstream extremity 111A (at second downstream position P2) formed at the center of the metallic panel 110 shown in FIG. 3A. Furthermore, the lateral ends of the paper P are reliably guided by the resin films 120 supported by a portion near the downstream extremity 111A at the center (at second downstream position P2). Here, the downstream extremity 121A of the resin film 120 is preferably extended to the same position (at second downstream position P2) as the downstream extremity 111A of the metallic panel 110. In other words, as the entire outer guide 100, the respective positions of the paper P in the widthwise direction are guided at the same position with respect to the transport direction of the paper, so that the paper P is guided toward the register rollers 28 with high degree of accuracy. Even when they are not extended to the same position as the downstream extremity 111A of the metallic panel 110, a certain degree of above-described effects are obtained as long as they are extended to a position downstream from the depressed portions 111B (at third downstream position P3) and are not extended beyond the downstream extremity 111A (at second downstream position P2).

Here, formation of the depressed portions 111B on the metallic panel 110 is sufficient if only restraining the noise caused by the springback of the trailing end is necessary as described above. However, in this case, guiding of the leading end of the paper P is unstable. Therefore, by providing the resin films 120 so as to be superimposed on the depressed portions 111B, both the prevention of the springback of the trailing end and guiding of the leading end are achieved.

When the leading end of the paper P leaves the outer guide 100, a force exerted from the leading end to the outer guide 100 is small because the distance between the leading end and a portion nipped by the pair of rollers 26 and 27 (see FIG. 1) is long, so that the resin films 120 are not deflected by a force exerted by the leading end, and the leading end is desirably guided. In contrast, when the trailing end of the paper P leaves the outer guide 100, a force exerted from the trailing end to the outer guide 100 is large because the distance between the trailing end and a portion nipped by the pair of register rollers 28 is short, so that the resin films 120 are deflected at the trailing end and the noise caused by the springback of the trailing end is restrained.

In this embodiment, the center portion and the both end portions of the metallic panel 110 correspond to second outer guide portions, and a portion between the center portion and the both end portions of the metallic panel 110 correspond to first outer guide portions. Then, the portions superimposed on the first outer guide portions of the resin films 120 extend to a position P3. The position P3 is a position downstream from a position P1 to which the first outer guide portions extend, and is not beyond the position P2 to which the second outer guide portions extend.

In the configuration described above, in this embodiment, the following effects are achieved.

Parts of the downstream end portions 121 of the resin films 120 protrude from the downstream end portions 111 (depressed portions 111B) of the metallic panel 110 and assume the resiliently deformable free ends, and the downstream end portions 121 of the resin films 120 do not protrude from the downstream extremities 111A of the metallic panel 110. Therefore, the restraint of the noise caused by the springback of the trailing end of the paper P and the maintenance of the guide function are both achieved.

Since the resin films 120 are fixed to the surface of the metallic panel 110 on the side of the transporting path F, there is no step formed between the downstream end portions 111 of the metallic panel 110 (the laterally inside portions B1 of the depressed portions 111B shown in FIG. 3A) and the resin films 120. In contrast, when the resin films 120 are fixed to the surface of the metallic panel 110 on the opposite side from the transporting path F, there are formed steps between the laterally inside portions B1 of the depressed portions 111B and the resin films 120. When such the steps are formed, there is a possibility of occurrence of noise caused by abutment of the trailing end of the paper P with the resin film 120 when the trailing end leaves the steps. However, no step is formed in this embodiment, and hence such the noise is restrained.

Since the metallic panel 110 is formed into a widthwise symmetrical shape with reference to the center of the paper P to be transported, the leading end portion of the paper P leaves the metallic panel 110 in a manner well balanced in the widthwise direction, so that the bias feeding of the paper P is restrained.

Since the widthwise center portion of the downstream end portion 111 of the metallic panel 110 is formed into an angular shape having a top at the downstream extremity 111A at the center, the center portion of the paper P is guided to a portion near the nip portion N of the register rollers 28 reliably in comparison with a mode in which the widthwise center portion is formed into a trough shape.

Since the portions of the resin films 120 which assume the free ends are arranged at the positions corresponding to the widthwise both edges of the narrow paper P, high noise caused by the springback of the trailing end in the case of the elastic narrow paper P such as the post card is satisfactorily restrained. Also, since the downstream end portion 111 of the metallic panel 110 has a shape having the three downstream extremities 111A, the wide paper P of a size such as A4 size with low elasticity is guided satisfactorily by the three downstream extremities 111A.

Since the surface of the outer guide 100 opposite from the inner guide 200 is formed as the guide surface 112 which guides the paper P linearly toward the register rollers 28, part of the transporting path for the manual paper feed is formed by the outer guide 100. Therefore, it is no longer necessary to provide a member which forms part of the transporting path for the manual paper feed separately from the outer guide 100, so that downsizing of the apparatus is achieved.

Since the metallic panel 110 as the conductive member is exposed toward the inner guide 200 so as to come into abutment with the paper P fed from the upstream side, a charge is removed from the paper P and duplicated feeding of the paper P is restrained.

Since the side surfaces 123 (123A) of the downstream end portions 121 of the resin films 120 having no adhesive agent applied thereto are formed linearly along the transport direction, the downstream end portions 121 of the resin films 120 are prevented from being turned back by the paper P and hence the transport of the paper P is prevented in comparison with a mode in which the side surfaces 123 (123A) of the downstream end portions 121 are inclined so as to be narrowed toward the downstream side.

Since the side surfaces 123 (123B) of the base portion 122 of the resin films 120 are inclined so as to be widened toward the upstream side, the paper P being in abutment with the metallic panel 110 is compressed by the respective inclined side surfaces 123 and hence is separated from the metallic panel 110 by its repulsive force. Therefore, the transfer current is prevented from leaking from the transfer roller 74 via the paper P or the metallic panel 110.

Since the exposed area DA is formed continuously from one end to the other end of the metallic panel 110 with respect to the transport direction of the paper, the paper P is prevented from being caught by the stepped surfaces ST formed between the metallic panel 110 and the resin film 120 and the smooth transport of the paper P is achieved.

The invention is not limited to the embodiment described above, and may be used in various modes as shown below.

In the embodiment described above, the invention is applied to the color printer 1. However, the invention is not limited thereto, and may be applied to other image forming apparatuses, for example, monochrome printers, intermediate transfer type printers, four-cycle system printers, and copying machines or multifunctional peripherals, and also may be applied to the paper transporting devices.

Figure 6A:
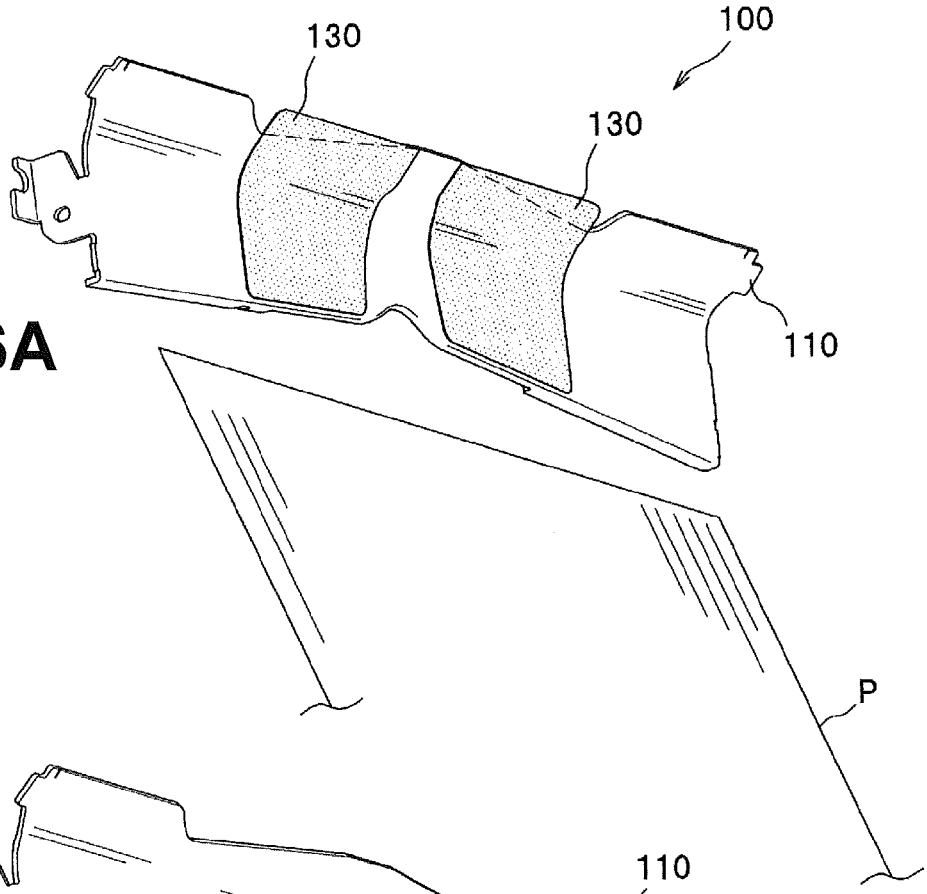
FIG. 6A is a perspective view showing a mode in which the resin films are formed to have a narrow width.
Figure 6B:
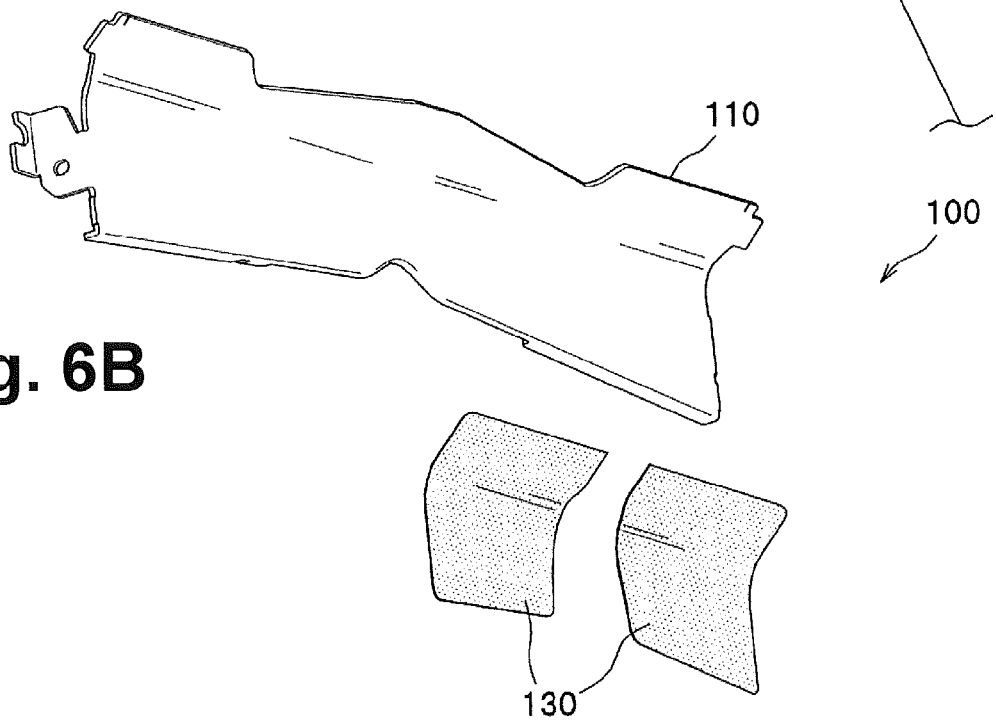
FIG. 6B is an exploded perspective view showing the mode in which the resin films are formed to have the narrow width.

In the embodiment described above, part of the resin film 120 is designed to be the free end by forming the notch 121B at the downstream end portion 121 of the resin film 120. However, the invention is not limited thereto. For example, as shown in FIG. 6A and FIG. 6B, a resin film 130 having a shape such that a widthwise outer portion with respect to the notch 121B of the resin film 120 according to the embodiment described above is cut off may be employed. In other words, what is essential is that the downstream end portions of the resin films extend widthwise outward from the downstream extremity of the rigid guide at the widthwise center thereof and then bent toward the bottom portions of the depressed portions before reaching the downstream extremities at the widthwise both sides.

Figure 7A:
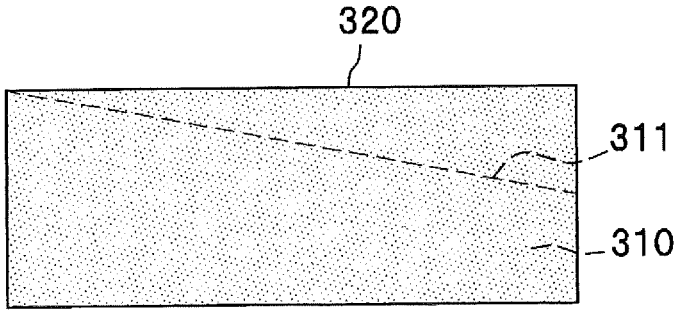
FIG. 7A is a plan view showing a first modification of the outer guide.
Figure 7B:
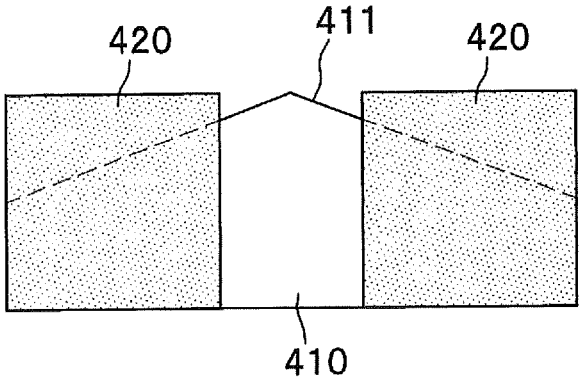
FIG. 7B is a plan view showing a second modification of the outer guide.
Figure 7C:
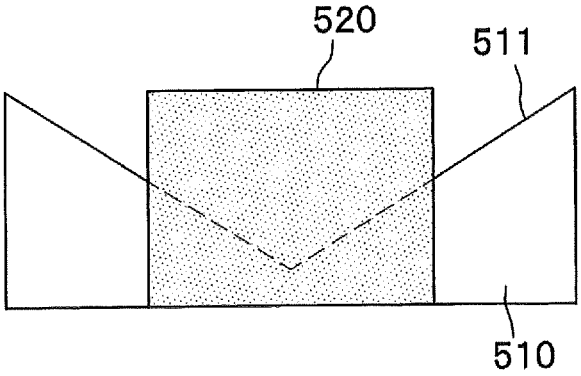
FIG. 7C is a plan view showing a third modification of the outer guide.

Various rigid guides such as a rigid guide 310 in which the widthwise entire portion of a downstream end portion 311 positioned at a different position with respect to the transport direction (a right end portion corresponds to the first outer guide portion, and a left end portion corresponds to the second outer guide portion) as shown in FIG. 7A, a rigid guide 410 in which a downstream end portion 411 assumes an angular shape as a whole (both end portions correspond to the first outer guide portions and a center portion corresponds to the second outer guide portion) as shown in FIG. 7B, and a rigid guide 510 in which a downstream end portion 511 assumes a trough shape as a whole (a center portion corresponds to the first outer guide portion and both end portions correspond to the second outer guide portion) as shown in FIG. 7C may be employed. In such a case, respective resilient guides 320, 420, and 520 may be formed and arranged as needed so as to protrude from at least part (portion on the upstream side) of the downstream end portions 311, 411, and 511 of the respective rigid guides 310, 410, and 510 once and extend to a downstream-most portion, or not to go beyond the same.

In the embodiment described above, the rigid guide is formed of the conductive member (metallic panel 110). However, the invention is not limited thereto, and may be formed of a non-conductive member. Also, the conductive member is not limited to the metallic panel 110, and a panel or the like formed of conductive resin may also be employed. The resilient guide is not limited to the resin film 120, and may be a rubber sheet having a smooth surface.

Although the photosensitive drum 53 is employed as the photosensitive member in the embodiment described above, the invention is not limited thereto and, for example, the belt-shaped photosensitive member may be employed. Although the transfer roller 74 is employed as the transfer member in the embodiment described above, the invention is not limited thereto and, for example, a member which does not have a roller shape may be employed. Although the papers P such as the thick paper, the post card, and the thin paper are employed as examples of the recording sheet in the embodiment described above, the invention is not limited thereto and, for example, OHP sheets may be employed.

Although the resin film 120 has been divided into two halves in the embodiment described above, it may be divided into three or more parts. Although the resin film 120 is divided at the center of the paper P to be transported in the embodiment described above, it may be divided at a position shifted from the center in the widthwise direction. In addition, although the portions 123A of the respective side surfaces 123 which come to the center side of the parts of resin film 120 divided into two halves and correspond to the downstream end portions 121 are formed to extend linearly along the transport direction in the embodiment described above, they may be inclined so as to widen toward the downstream side.

What is claimed is:

1. An image forming apparatus comprising:

an image forming unit configured to form an image on a recording sheet;

a feeder configured to nip and transport the recording sheet; and guide portions that define a curved transporting path configured to guide the recording sheet in a transport direction toward the feeder while bending the recording sheet into an arcuate shape, wherein the guide portions include an outer guide arranged on an outer peripheral side of the curved transporting path and an inner guide arranged on an inner peripheral side so as to oppose the outer guide, wherein the outer guide includes a rigid guide and a deformable resilient guide superimposed with each other, wherein the rigid guide comprises a downstream end with respect to the transport direction, wherein the downstream end of the rigid guide comprises a depressed portion and an extremity, wherein the depressed portion of the downstream end is located upstream from the extremity of the downstream end, wherein the downstream end of the rigid guide comprises a portion formed into an angular shape with a vertex of the angular shape being located at the center of the downstream end; and wherein the resilient guide includes a deformable free end which protrudes downstream of the depressed portion but does not protrude downstream of the extremity.

2. The image forming apparatus according to claim 1, wherein the resilient guide is formed of a resin film and is fixed to the rigid guide on a side of a recording sheet transporting surface.

3. The image forming apparatus according to claim 1, wherein the downstream end of the rigid guide is symmetrical, in a direction substantially perpendicular to the transport direction, about a center of the downstream end.

4. The image forming apparatus according to claim 1, wherein the outer guide is formed to have a width corresponding to at least two types of recording sheets having different widths, wherein the downstream end of the rigid guide includes:

a first downstream extremity formed at a center of the downstream end, and a second and third downstream extremity formed at each of the two sides of the downstream end farthest from the center of the downstream end in a direction substantially perpendicular to the transport direction, respectively; and two depressed portions, one formed between the first and second extremities and one formed between the first and third extremities, wherein each of the depressed portions is depressed toward the upstream side with respect to the transport direction from the downstream extremities, and the positions of the two depressed portions in the direction substantially perpendicular to the transport direction correspond to the edges of a narrowest recording sheet of the two types of recording sheets, and wherein the downstream end of the resilient guide extends outwardly from the first downstream extremity in the direction substantially perpendicular to the transport direction and then bends toward the bottom portions of the respective depressed portions before reaching the second and third downstream extremities.

5. The image forming apparatus according to claim 1, wherein the outer guide is arranged such that a downstream end thereof with respect to the transport direction is positioned in the proximity of a nip portion of the feeder.

6. The image forming apparatus according to claim 1, wherein the outer and inner guides guide the recording sheet such that the downstream end of the recording sheet proceeds toward the nip portion of the feeder while in contact with the downstream end of the outer guide and a part of the inner guide positioned upstream of the downstream end of the outer guide.

7. The image forming apparatus according to claim 1, wherein the feeder comprises a pair of rollers which are in contact with each other at a nip position, and wherein the outer guide and the inner guide are positioned on a same side of a tangent line extending through the nip position.

8. The image forming apparatus according to claim 1, wherein the surface of the outer guide opposite from the inner guide includes a flat guide surface for linearly guiding the recording sheet toward the feeder.

9. The image forming apparatus according to claim 1, wherein the rigid guide is formed of a conductive material and is exposed toward the inner guide so as to come into abutment with the recording sheet fed from the upstream side with respect to the transport direction.

10. The image forming apparatus according to claim 9, wherein the resilient guide is formed of a resin film, wherein the resilient guide is fixed to the rigid guide on the upstream side of the rigid guide with an adhesive agent, wherein the resilient guide has the deformable free end at the downstream end of the rigid guide, and wherein the resilient guide is divided into two halves at a center of the downstream end of the rigid guide, and wherein a first portion of each side surface of each of the two halves of the resilient guide closest to the center of the rigid guide are substantially parallel and extend in the substantially same direction as the transport direction, and wherein a second portion of each side surface of each of the two halves of the resilient guide closest to the center of the of the rigid guide are inclined with an upstream end of each second portion located farther from the center of the rigid guide than a downstream end of each second portion.

11. The image forming apparatus according to claim 10, wherein the image forming unit is positioned downstream with respect to the transport direction from the feeder, and wherein the image forming unit includes a photosensitive member that carries a developer image.

12. An image forming apparatus comprising:

an image forming unit configured to form an image on a recording sheet;

an inner guide;

an outer guide opposing the inner guide; the inner guide and the outer guide defining a curved transporting path where the recording sheet is transported in a transport direction, the inner guide being positioned inside the curved transporting path, and the outer guide being positioned outside the curved transporting path;

a first feeder configured to feed the recording sheet to the curved transporting path; and a second feeder configured to nip and feed the recording sheet passing through the curved transporting path out of the curved transporting path, wherein the outer guide includes a rigid guide and a deformable resilient guide, the resilient guide is superimposed on the rigid guide, wherein the rigid guide integrally includes a first outer guide portion and a second outer guide portion, the first outer guide portion extends in the transport direction to a first downstream position and forms a first part of a downstream end of the outer guide, and the second outer guide portion extends in the transport direction to a second downstream position positioned downstream of the first downstream position and forms a second part of the downstream end of the outer guide, wherein the second outer guide portion comprises a first extremity formed at a center of the downstream end of the rigid guide, and a second and third extremity formed at each of the two sides of the downstream end of the rigid guide farthest from the center of the downstream end in a direction substantially perpendicular to the transport direction, respectively, wherein the first outer guide portion comprises two depressed portions, one formed between the first and second extremities and one formed between the first and third extremities, and wherein the resilient guide includes a first resilient guide portion corresponding to the first outer guide portion, the first resilient guide portion extends in the transport direction to a third downstream position which is positioned downstream of the first downstream position and does not extend beyond the second downstream position such that a downstream end of the first resilient guide portion is deformable as a free end.

13. The image forming apparatus according to claim 12, wherein the resilient guide includes a resin film.

14. The image forming apparatus according to claim 12, wherein the resilient guide is fixed to the rigid guide on a side of the curved transporting path.

15. The image forming apparatus according to claim 12, wherein the free end of the resilient guide includes a corner formed by first extending outwardly from a center of a downstream end of the rigid guide in a direction substantially perpendicular to the transport direction and by second extending upstream with respect to the transport direction.

16. The image forming apparatus according to claim 12, wherein the second feeder includes a pair of rollers contacting with each other at a nip position, and wherein the outer guide and the inner guide are positioned only on a same side of a tangent line extending through the nip position.

17. The image forming apparatus according to claim 12, wherein the image forming unit is positioned downstream of the second feeder.

18. The image forming apparatus according to claim 12, wherein the image forming unit forms an image on the recording sheet by an electrophotographic system.

19. An image forming apparatus comprising:

an image forming unit configured to form an image on a recording sheet;

a feeder configured to nip and transport the recording sheet; and guide portions that define a curved transporting path configured to guide the recording sheet in a transport direction toward the feeder while bending the recording sheet into an arcuate shape, wherein the guide portions include an outer guide arranged on an outer peripheral side of the curved transporting path and an inner guide arranged on an inner peripheral side so as to oppose the outer guide, wherein the outer guide includes a rigid guide and a deformable resilient guide, wherein the rigid guide comprises a downstream end with respect to the transport direction which extends substantially perpendicular to the transport direction and comprises a depressed portion and an extremity, wherein the depressed portion of the downstream end is located upstream from the extremity of the downstream end, wherein the resilient guide includes a deformable free end which protrudes downstream of the depressed portion but does not protrude downstream of the extremity, and wherein the rigid guide has a curved inner surface facing the curved transport path and the resilient guide covers the curved inner surface and defines a portion of the curved transporting path.

20. The image forming apparatus according to claim 19, wherein the downstream end of the rigid guide comprises a portion formed into an angular shape with a vertex of the angular shape being located at the center of the downstream end.

* * * * *